US007861808B2

(12) United States Patent
Zhang et al.

(10) Patent No.: US 7,861,808 B2
(45) Date of Patent: Jan. 4, 2011

(54) CUTTER FOR MAINTAINING EDGE SHARPNESS

(75) Inventors: Youhe Zhang, Tomball, TX (US); Yuelin Shen, Houston, TX (US)

(73) Assignee: Smith International, Inc., Houston, TX (US)

( * ) Notice: Subject to any disclaimer, the term of this patent is extended or adjusted under 35 U.S.C. 154(b) by 131 days.

(21) Appl. No.: 11/365,298

(22) Filed: Mar. 1, 2006

(65) Prior Publication Data

US 2006/0201712 A1 Sep. 14, 2006

Related U.S. Application Data

(60) Provisional application No. 60/660,765, filed on Mar. 11, 2005.

(51) Int. Cl.
*E21B 10/58* (2006.01)

(52) U.S. Cl. ..... 175/428; 175/432

(58) Field of Classification Search ..... 175/420.1, 175/426, 428, 432
See application file for complete search history.

(56) References Cited

U.S. PATENT DOCUMENTS

| | | | | |
|---|---|---|---|---|
| 3,745,623 | A | 7/1973 | Wentorf et al. | |
| 3,858,671 | A | 1/1975 | Kita et al. | |
| 4,104,344 | A | 8/1978 | Pope et al. | |
| 4,288,248 | A | 9/1981 | Bovenkerk et al. | |
| 4,804,049 | A | 2/1989 | Barr et al. | |
| 4,993,505 | A | 2/1991 | Packer et al. | |
| 5,316,095 | A * | 5/1994 | Tibbitts | 175/429 |
| 5,332,051 | A | 7/1994 | Knowlton | |
| 5,341,890 | A | 8/1994 | Cawthorne et al. | |
| 5,655,612 | A | 8/1997 | Grimes et al. | |
| 5,662,183 | A | 9/1997 | Fang | |
| 5,706,906 | A | 1/1998 | Jurewicz et al. | |
| 5,947,216 | A | 9/1999 | Truax | |
| 6,003,623 | A | 12/1999 | Miess | |
| 6,145,607 | A * | 11/2000 | Griffin et al. | 175/426 |
| 6,408,959 | B2 * | 6/2002 | Bertagnolli et al. | 175/432 |
| 6,488,106 | B1 * | 12/2002 | Dourfaye | 175/428 |
| 6,527,069 | B1 * | 3/2003 | Meiners et al. | 175/432 |
| 6,550,556 | B2 | 4/2003 | Middlemiss et al. | |
| 6,604,588 | B2 | 8/2003 | Eyre et al. | |
| 6,823,952 | B1 | 11/2004 | Mensa-Wilmot et al. | |
| 6,904,984 | B1 | 6/2005 | Estes et al. | |
| 7,086,489 | B2 | 8/2006 | McDonough | |
| 2003/0235691 | A1 | 12/2003 | Griffin et al. | |

FOREIGN PATENT DOCUMENTS

| | | |
|---|---|---|
| BE | 1012119 | 5/2000 |
| CA | 2538807 | 9/2006 |

(Continued)

OTHER PUBLICATIONS

Examiner's Report dated Sep. 4, 2007 for Canadian Application No. 2,538,807, (3 pages).

(Continued)

*Primary Examiner*—Daniel P Stephenson

(57) ABSTRACT

A cutter comprising a base portion, an ultrahard layer disposed on said base portion, and at least one recessed region on an outer surface of the cutter. A start of the recessed region disposed a selected distance behind a cutting face.

9 Claims, 8 Drawing Sheets

FOREIGN PATENT DOCUMENTS

| | | |
|---|---|---|
| CA | 2541267 | 12/2008 |
| EP | 1201873 | 5/2002 |
| GB | 2314360 | 12/1997 |
| GB | 2361936 | 11/2001 |
| GB | 2424013 | 6/2007 |
| GB | 2424910 | 2/2008 |

OTHER PUBLICATIONS

Combined Search and Examination Report issued in UK Application No. GB0604699.9 dated Jul. 7, 2006 (6 pages).
CA Examination Report for CA App. No. 2,538,807 dated Jul. 20, 2009.
Notice of Allowance dated Jan. 13, 2010 for related U.S. Appl. No. 11/372,614, filed Mar. 10, 2006.
Non-Final Office Action dated Sep. 21, 2007 for related U.S. Appl. No. 11/372,614, filed Mar. 10, 2006.
Final Office Action dated Apr. 4, 2008 for related U.S. Appl. No. 11/372,614, filed Mar. 10, 2006.
Non-Final Office Action dated Jul. 28, 2008 for related U.S. Appl. No. 11/372,614, filed Mar. 10, 2006.
Final Office Action dated Jan. 27, 2009 for related U.S. Appl. No. 11/372,614, filed Mar. 10, 2006.
Non-Final Office Action dated Jun. 25, 2009 for related U.S. Appl. No. 11/372,614, filed Mar. 10, 2006.
Response filed Mar. 4, 2008 to CA Exam Report dated Sep. 4, 2007 for corresponding CA application No. 2,538,807.
Response filed Mar. 18, 2009 to CA Exam Report dated Oct. 2, 2008 for corresponding CA application No. 2,538,807.
CA Exam report dated Oct. 2, 2008 for corresponding CA application 2,538,807.
Response filed Jan. 12, 2010 to CA Exam Report dated Jul. 20, 2009 for corresponding CA application No. 2,538,807.
Response filed Sep. 26, 2006 to UK Combined Search and Examination Report dated Jul. 7, 2006 for corresponding GB application No. 0604699.9.
CA Exam Report dated Jul. 24, 2007 for related CA application No. 2,541,267.
Response filed Jan. 18, 2008 to CA Exam Report dated Jul. 24, 2007 for related CA application No. 2,541,267.
GB Exam Report dated Jul. 31, 2006 for related GB application No. 0606575.9.
Response file Mar. 23, 2007 to GB Exam Report dated Jul. 31, 2006 for related GB application No. 0606575.9.

* cited by examiner

CUTTER FOR MAINTAINING EDGE SHARPNESS

CROSS-REFERENCE TO RELATED APPLICATIONS

This application claims benefit under 35 U.S.C. §119 to U.S. Provisional Application Ser. No. 60/660,765, filed on Mar. 11, 2005. This provisional application is hereby incorporated by reference in its entirety.

BACKGROUND OF INVENTION

1. Field of the Invention

The invention relates generally to a method for producing compact PDC with Improved performance through maintaining edge sharpness.

2. Background Art

Rotary drill bits with no moving elements on them are typically referred to as "drag" bits. Drag bits are often used to drill a variety of rock formations. Drag bits include those having cutters (sometimes referred to as cutter elements, cutting elements or inserts) attached to the bit body. For example, the cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

An example of a prior art drag bit having a plurality of cutters with ultra hard working surfaces is shown in FIG. 1. The drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22.

Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14 and the cutters 18. The drilling fluid also cleans and removes the cuttings as the drill bit rotates and penetrates the geological formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate toughness, while providing good resistance to abrasive and erosive wear. For example, in the case where an ultra hard cutter is to be used, the bit body 12 may be made from powdered tungsten carbide (WC) infiltrated with a binder alloy within a suitable mold form. In one manufacturing process the crown 26 includes a plurality of holes or pockets 34 that are sized and shaped to receive a corresponding plurality of cutters 18.

The combined plurality of surfaces 20 of the cutters 18 effectively forms the cutting face of the drill bit 10. Once the crown 26 is formed, the cutters 18 are positioned in the pockets 34 and affixed by any suitable method, such as brazing, adhesive, mechanical means such as interference fit, or the like. The design depicted provides the pockets 34 inclined with respect to the surface of the crown 26. The pockets 34 are inclined such that cutters 18 are oriented with the working face 20 at a desired rake angle in the direction of rotation of the bit 10, so as to enhance cutting. It will be understood that in an alternative construction (not shown), the cutters can each be substantially perpendicular to the surface of the crown, while an ultra hard surface is affixed to a substrate at an angle on a cutter body or a stud so that a desired rake angle is achieved at the working surface.

A typical cutter 18 is shown in FIG. 2. The typical cutter 18 has a cylindrical cemented carbide substrate body 38 having an end face or upper surface 54 referred to herein as the "interface surface" 54. An ultra hard material layer (cutting layer) 44, such as polycrystalline diamond or polycrystalline cubic boron nitride layer, forms the working surface 20 and the cutting edge 22. A bottom surface 52 of the cutting layer 44 is bonded on to the upper surface 54 of the substrate 38. The joining surfaces 52 and 54 are herein referred to as the interface 46. The top exposed surface or working surface 20 of the cutting layer 44 is opposite the bottom surface 52. The cutting layer 44 typically has a flat or planar working surface 20, but may also have a curved exposed surface, that meets the side surface 21 at a cutting edge 22.

Cutters may be made, for example, according to the teachings of U.S. Pat. No. 3,745,623, whereby a relatively small volume of ultra hard particles such as diamond or cubic boron nitride is sintered as a thin layer onto a cemented tungsten carbide substrate. Flat top surface cutters as shown in FIG. 2 are generally the most common and convenient to manufacture with an ultra hard layer according to known techniques. It has been found that cutter chipping, spalling and delamination are common failure modes for ultra hard flat top surface cutters.

Generally speaking, the process for making a cutter 18 employs a body of tungsten carbide as the substrate 38. The carbide body is placed adjacent to a layer of ultra hard material particles such as diamond or cubic boron nitride particles and the combination is subjected to high temperature at a pressure where the ultra hard material particles are thermodynamically stable. This results in recrystallization and formation of a polycrystalline ultra hard material layer, such as a polycrystalline diamond or polycrystalline cubic boron nitride layer, directly onto the upper surface 54 of the cemented tungsten carbide substrate 38.

It has been found by applicants that many cutters develop cracking, spalling, chipping and partial fracturing of the ultra hard material cutting layer at a region of cutting layer subjected to the highest loading during drilling. This region is referred to herein as the "critical region" 56. The critical region 56 encompasses the portion of the cutting layer 44 that makes contact with the earth formations during drilling. The critical region 56 is subjected to the generation of high magnitude stresses from dynamic normal loading, and shear loadings imposed on the ultra hard material layer 44 during drilling. Because the cutters are typically inserted into a drag bit at a rake angle, the critical region includes a portion of the ultra hard material layer near and including a portion of the layer's circumferential edge 22 that makes contact with the earth formations during drilling.

The high magnitude stresses at the critical region 56 alone or in combination with other factors, such as residual thermal stresses, can result in the initiation and growth of cracks 58 across the ultra hard layer 44 of the cutter 18. Cracks of sufficient length may cause the separation of a sufficiently large piece of ultra hard material, rendering the cutter 18 ineffective or resulting in the failure of the cutter 18. When this happens, drilling operations may have to be ceased to allow for recovery of the drag bit and replacement of the ineffective or failed cutter. The high stresses, particularly shear stresses, can also result in delamination of the ultra hard layer 44 at the interface 46.

One type of ultra hard working surface 20 for fixed cutter drill bits is formed as described above with polycrystalline diamond on the substrate of tungsten carbide, typically known as a polycrystalline diamond compact (PDC), PDC cutters, PDC cutting elements, or PDC inserts. Drill bits made using such PDC cutters 18 are known generally as PDC bits. While the cutter or cutter insert 18 is typically formed using a cylindrical tungsten carbide "blank" or substrate 38 which is sufficiently long to act as a mounting stud 40, the substrate 38 may also be an intermediate layer bonded at another interface to another metallic mounting stud 40.

The ultra hard working surface 20 is formed of the polycrystalline diamond material, in the form of a cutting layer 44 (sometimes referred to as a "table") bonded to the substrate 38 at an interface 46. The top of the ultra hard layer 44 provides a working surface 20 and the bottom of the ultra hard layer cutting layer 44 is affixed to the tungsten carbide substrate 38 at the interface 46. The substrate 38 or stud 40 is brazed or otherwise bonded in a selected position on the crown of the drill bit body 12 (FIG. 1). As discussed above with reference to FIG. 1, the PDC cutters 18 are typically held and brazed into pockets 34 formed in the drill bit body at predetermined positions for the purpose of receiving the cutters 18 and presenting them to the geological formation at a rake angle.

In order for the body of a drill bit to be resistant to wear, hard and wear-resistant materials such as tungsten carbide are typically used to form the drill bit body for holding the PDC cutters. Such a drill bit body is very hard and difficult to machine. Therefore, the selected positions at which the PDC cutters 18 are to be affixed to the bit body 12 are typically formed during the bit body molding process to closely approximate the desired final shape. A common practice in molding the drill bit body is to include in the mold, at each of the to-be-formed PDC cutter mounting positions, a shaping element called a "displacement."

A displacement is generally a small cylinder, made from graphite or other heat resistant materials, which is affixed to the inside of the mold at each of the places where a PDC cutter is to be located on the finished drill bit. The displacement forms the shape of the cutter mounting positions during the bit body molding process. See, for example, U.S. Pat. No. 5,662,183 issued to Fang for a description of the infiltration molding process using displacements.

It has been found by applicants that cutters with sharp cutting edges or small back rake angles provide a good drilling ROP, but are often subject to instability and are susceptible to chipping, cracking or partial fracturing when subjected to high forces normal to the working surface. For example, large forces can be generated when the cutter "digs" or "gouges" deep into the geological formation or when sudden changes in formation hardness produce sudden impact loads. Small back rake angles also have less delamination resistance when subjected to shear load. Cutters with large back rake angles are often subjected to heavy wear, abrasion and shear forces resulting in chipping, spalling, and delamination due to excessive downward force or weight on bit (WOB) required to obtain reasonable ROP. Thick ultra hard layers that might be good for abrasion wear are often susceptible to cracking, spalling, and delamination as a result of residual thermal stresses associated with forming thick ultra hard layers on the substrate. The susceptibility to such deterioration and failure mechanisms is accelerated when combined with excessive load stresses.

FIG. 3 shows a prior art PDC cutter held at an angle in a drill bit 10 for cutting into a formation 45. The cutter 18 includes a diamond material table 44 affixed to a tungsten carbide substrate 38 that is bonded into the pocket 34 formed in a drill bit blade 14. The drill bit 10 (see FIG. 1) will be rotated for cutting the inside surface of a cylindrical well bore. Generally speaking, the back rake angle "A" is used to describe the working angle of the working surface 20, and it also corresponds generally to the magnitude of the attack angle "B" made between the working surface 20 and an imaginary tangent line at the point of contact with the well bore. It will be understood that the "point" of contact is actually an edge or region of contact that corresponds to critical region 56 (see FIG. 2) of maximum stress on the cutter 18. Typically, the geometry of the cutter 18 relative to the well bore is described in terms of the back rake angle "A."

Different types of bits are generally selected based on the nature of the geological formation to be drilled. Drag bits are typically selected for relatively soft formations such as sands, clays and some soft rock formations that are not excessively hard or excessively abrasive. However, selecting the best bit is not always straightforward because many formations have mixed characteristics (i.e., the geological formation may include both hard and soft zones), depending on the location and depth of the well bore. Changes in the geological formation can affect the desired type of a bit, the desired ROP of a bit, the desired rotation speed, and the desired downward force or WOB. Where a drill bit is operated outside the desired ranges of operation, the bit can be damaged or the life of the bit can be severely reduced.

For example, a drill bit normally operated in one general type of formation may penetrate into a different formation too rapidly or too slowly subjecting it to too little load or too much load. For another example, a drill bit rotating and penetrating at a desired speed may encounter an unexpectedly hard formation material, possibly subjecting the bit to a "surprise" or sudden impact force. A formation material that is softer than expected may result in a high rate of rotation, a high ROP, or both, that can cause the cutters to shear too deeply or to gouge into the geological formation.

This can place greater loading, excessive shear forces and added heat on the working surface of the cutters. Rotation speeds that are too high without sufficient WOB, for a particular drill bit design in a given formation, can also result in detrimental instability (bit whirling) and chattering because the drill bit cuts too deeply or intermittently bites into the geological formation. Cutter chipping, spalling, and delamination, in these and other situations, are common failure modes for ultra hard flat top surface cutters.

Dome top cutters, which have dome-shaped top surfaces, have provided certain benefits against gouging and the resultant excessive impact loading and instability. This approach for reducing adverse effects of flat surface cutters is described in U.S. Pat. No. 5,332,051. An example of such a dome cutter in operation is depicted in FIG. 4. The prior art cutter 60 has a dome shaped top or working surface 62 that is formed with an ultra hard layer 64 bonded to a substrate 66. The substrate 66 is bonded to a metallic stud 68. The cutter 60 is held in a blade 70 of a drill bit 72 (shown in partial section) and engaged with a geological formation 74 (also shown in partial section) in a cutting operation. The dome shaped working surface 62 effectively modifies the rake angle A that would be produced by the orientation of the cutter 60.

Scoop top cutters, as shown at 80 in FIG. 5 (U.S. Pat. No. 6,550,556), have also provided some benefits against the adverse effects of impact loading. This type of prior art cutter 80 is made with a "scoop" or depression 90 formed in the top working surface 82 of an ultra hard layer 84. The ultra hard layer 84 is bonded to a substrate 86 at an interface 88. The depression 90 is formed in the critical region 56. The upper surface 92 of the substrate 86 has a depression 94 corresponding to the depression 90, such that the depression 90 does not make the ultra hard layer 84 too thin. The interface 88 may be referred to as a non-planar interface (NPI).

Beveled or radiused cutters have provided increased durability for rock drilling. U.S. Pat. Nos. 6,003,623 and 5,706,906 disclose cutters with radiused or beveled side wall. An example of such a cutter is shown at 100 in FIG. 6. This type of prior art cutter 100 has a cylindrical mount section 108 with a cutting section, or diamond cap, 102 formed at one of its axial ends. The diamond cap 102 includes a cylindrical wall section 107. An annular, arc surface (radiused surface) 109 extends laterally and longitudinally between planar end surface 103 and the external surface of the cylindrical wall section 107. The radiused surface 109 is in the form of a surface of revolution of an arc line segment that is concave relative to the axis of revolution 105.

FIG. 7 shows a conventional cutter 200 with cutter edge 203 engaging a formation 212. The cutter 200 is a fresh, or unused, cutter with a sharp cutting edge 203. Over time, the cutting edge 203 of conventional cutter 200, experiences wear that dulls the cutting edge 203*a*, shown in FIG. 8. As the cutting edge 203*a* dulls, it generates a larger weight-bearing surface. The weight-bearing surface is defined as the area of contact between the cutter 200 and the formation 212. As the weight-bearing surface increases, more WOB may be applied in order to maintain ROP of the drill bit. As a result, more friction heat is generated between the formation 212 and the cutter 203. Consequently, the additional WOB and friction heat may cause the cutter to spall or crack.

While conventional PDC cutters have been designed to increase the durability for rock drilling, cutting efficiency usually decreases. The cutting efficiency decreases as a result of the cutter dulling, thereby increasing the weight-bearing area. As a result, more WOB must be applied. The additional WOB generates more friction and heat and may result in spalling or cracking of the cutter.

What is still needed, therefore, are improved cutters for use in a variety of applications that increase the durability as well as cutting efficiency of the cutter.

SUMMARY OF INVENTION

In one aspect, the invention provides an improved cutter. In one aspect, the cutter comprises a base portion, an ultrahard layer disposed on said base portion, and at least one recessed region on the outer surface of the cutter. A start of the at least one recessed region is disposed a selected distance behind the cutting face.

In another aspect, the invention provides a cutter wherein the at least one recessed region comprises a full cut around the circumference of the cutter.

In another aspect, the invention provides a drill bit comprising a bit body and at least one cutter, the at least one cutter comprising a base portion, an ultrahard layer disposed on said base portion, and at least one recessed region on an outer surface of the cutter. A start of the at least one recessed region is disposed a selected distance behind a cutting face.

In another aspect, the invention provides a method of drilling comprising contacting a formation with a drill bit, wherein the drill comprises a bit body and at least one cutter. The at least one cutter comprises a base portion, an ultrahard layer disposed on said base portion, and at least one recessed region on an outer surface of the cutter, wherein a start of the at least one recessed region is disposed a selected distance behind a cutting face.

Other aspects and advantages of the invention will be apparent from the following description and the appended claims.

DETAILED DESCRIPTION

Figure 1:
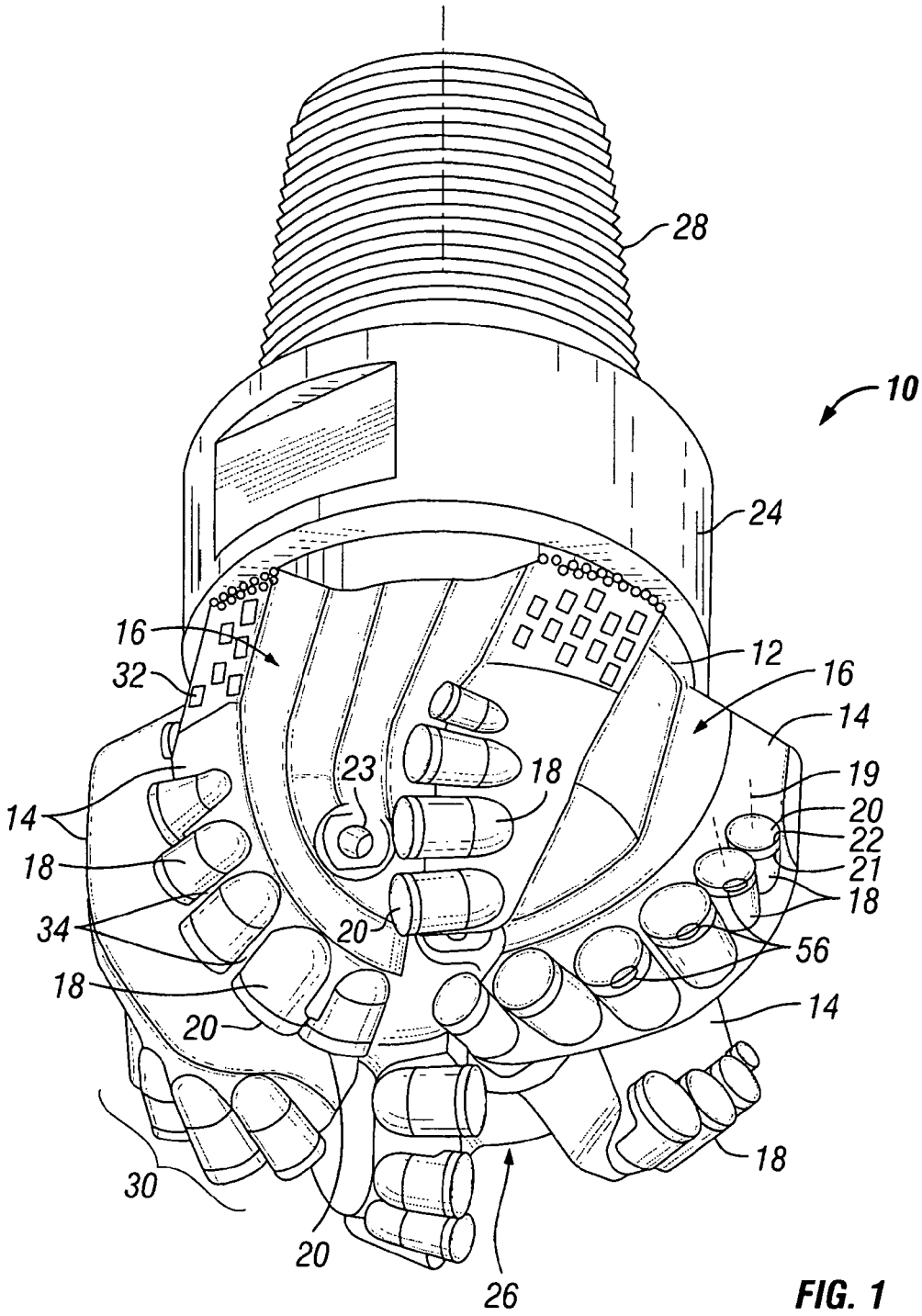
FIG. 1 (Prior Art)
FIG. 1 is a perspective view of a prior art fixed cutter drill bit sometimes referred to as a "drag bit"
Figure 2:
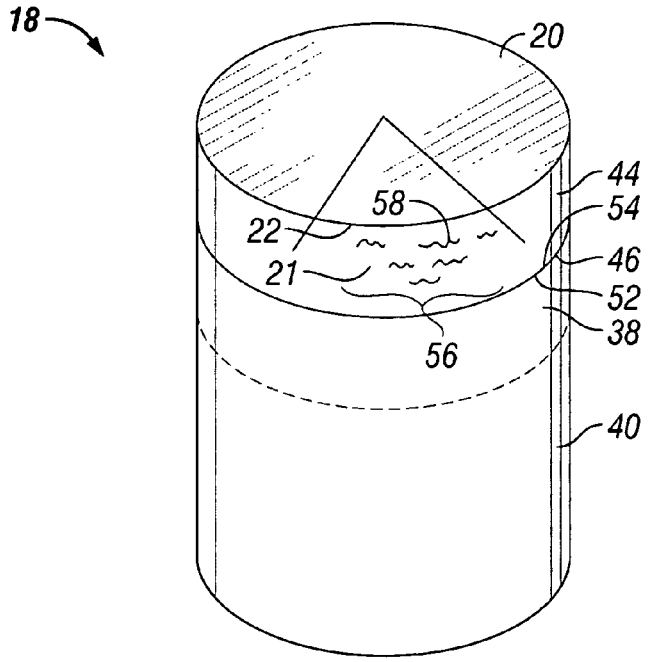
FIG. 2 (Prior Art)
FIG. 2 is a perspective view of a prior art cutter or cutter insert with an ultra hard layer bonded to a substrate or stud.
Figure 3:
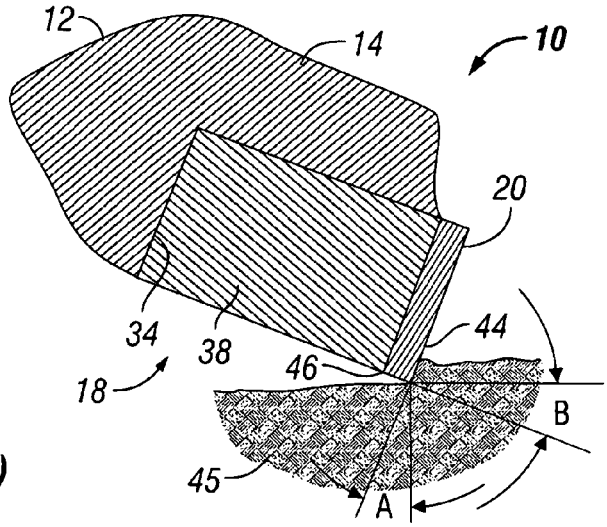
FIG. 3 (Prior Art)
FIG. 3 is a partial section view of a prior art flat top cutter held in a blade of a drill bit engaged with a geological formation (shown in partial section) in a cutting operation.
Figure 4:
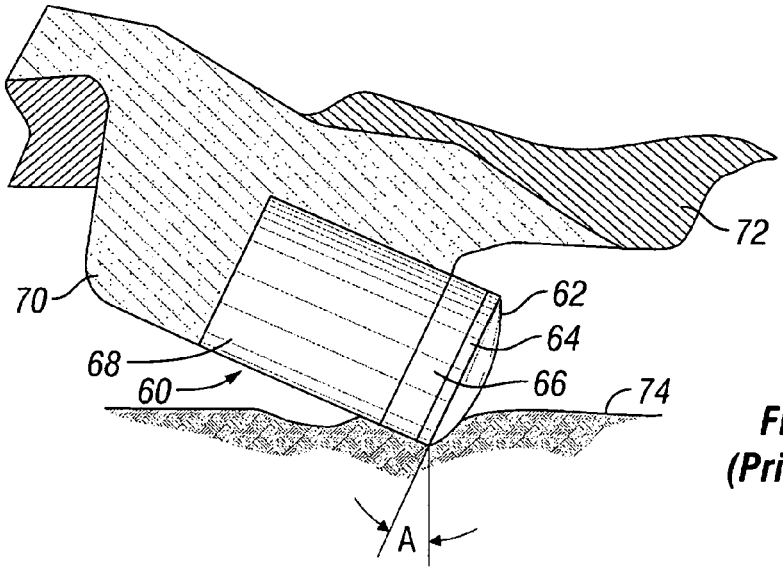
FIG. 4 (Prior Art)
FIG. 4 is a schematic view of a prior art dome top cutter with an ultra hard layer bonded to a substrate that is bonded to a stud, where the cutter is held in a blade of a drill bit (shown in partial section) and engaged with a geological formation (also shown in partial section) in a cutting operation.
Figure 5:
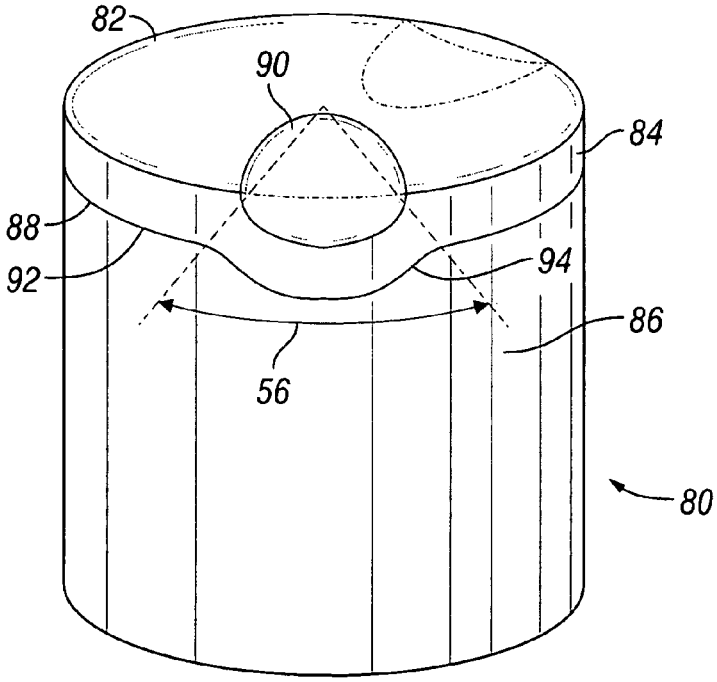
FIG. 5 (Prior Art)
FIG. 5 is a perspective view of a prior art scoop top cutter with an ultra hard layer bonded to a substrate at a non-planar interface (NPI)
Figure 6:
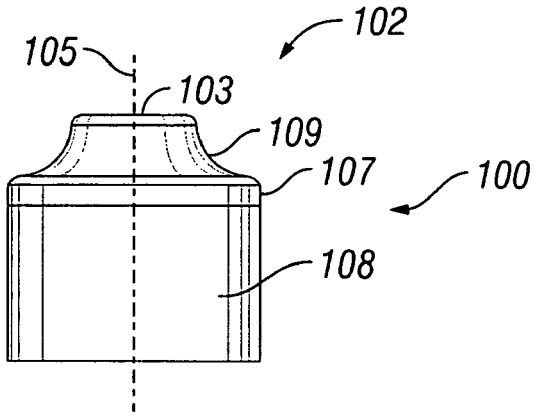
FIG. 6 (Prior Art)
FIG. 6 is a schematic view of a prior art radiused cutter with an ultra hard layer bonded to a substrate.
Figure 7:
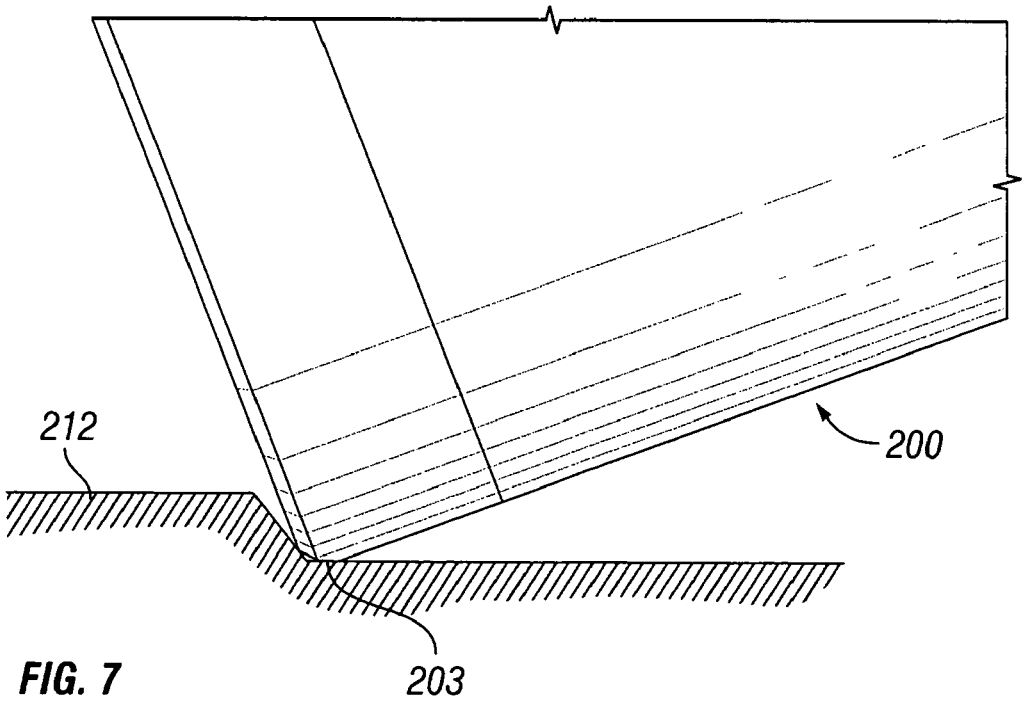
FIG. 7 (Prior Art)
FIG. 7 is a schematic partial view of a prior art cutter engaging a formation when it is new (unused)

The present invention relates to shaped cutters that provide advantages when compared to prior art cutters. In particular, embodiments of the present invention relate to cutters that have structural modifications to the cutting edge in order to improve cutter performance. As a result of the modifications, embodiments of the present invention may provide improved cooling, higher cutting efficiency, improved cutter durability, and longer lasting cutters when compared with prior art cutters. More specifically, embodiments of the present invention may improve cutting edge sharpness during use and reduce potential mechanical or thermal breakdown of the cutter.

Embodiments of the present invention relate to cutters having a substrate or support stud, which in some embodiments may be made of carbide, for example tungsten carbide, and an ultra hard cutting surface layer or "table" made of a polycrystalline diamond material or a polycrystalline boron nitride material deposited onto or otherwise bonded to the substrate at an interface surface. Also, in selected embodiments, the ultra-hard layer may comprise a "thermally stable"

layer. One type of thermally stable layer that may be used in embodiments of the present invention is leached polycrystalline diamond.

A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

In order to obviate this problem, strong acids may be used to "leach" the cobalt from the diamond lattice structure. Examples of "leaching" processes can be found, for example in U.S. Pat. Nos. 4,288,248 and 4,104,344. Briefly, a hot strong acid, e.g., nitric acid, hydrofluoric acid, hydrochloric acid, or perchloric acid, or combinations of several strong acids may be used to treat the diamond table, removing at least a portion of the catalyst from the PDC layer.

Removing the cobalt causes the diamond table to become more heat resistant, but also causes the diamond table to be more brittle. Accordingly, in certain cases, only a select portion (measured either in depth or width) of a diamond table is leached, in order to gain thermal stability without losing impact resistance. As used herein, thermally stable polycrystalline diamond compacts include both of the above (i.e., partially and completely leached) compounds. In one embodiment of the invention, only a portion of the polycrystalline diamond compact layer is leached. For example, a polycrystalline diamond compact layer having a thickness of 0.010 inches may be leached to a depth of 0.006 inches. In other embodiments of the invention, the entire polycrystalline diamond compact layer may be leached. A number of leaching depths may be used, depending on the particular application, for example, in one embodiment the leaching depth may be 0.05 in.

Figure 10:
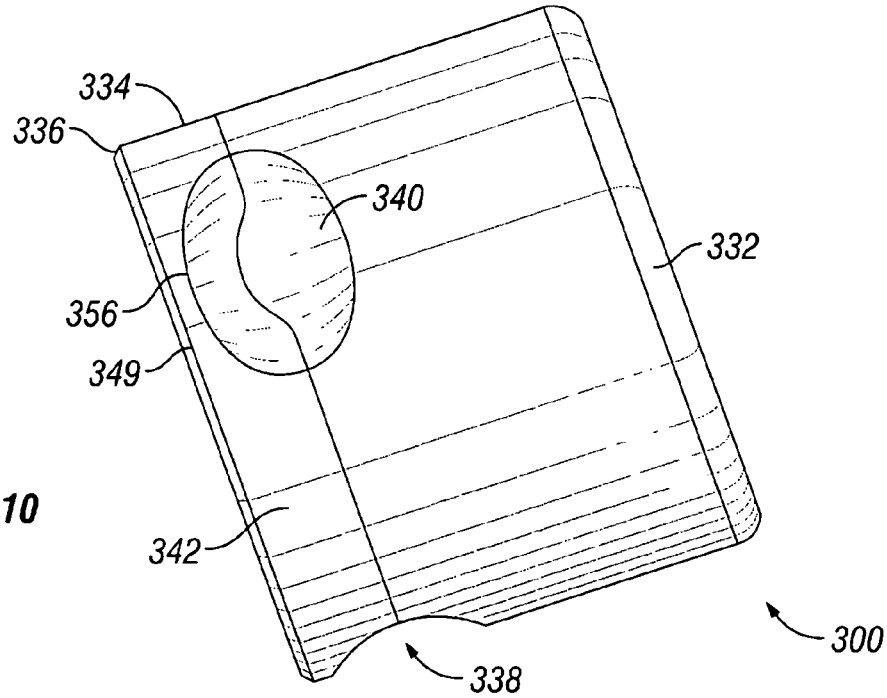
FIG. 10 shows a cutter in accordance with an embodiment of the present invention.

FIG. 10 shows a cutter formed in accordance with an embodiment of the present invention. In FIG. 10, a cutter 330 comprises a substrate or "base portion," 332, on which an ultrahard layer 334 is disposed. In this embodiment, the ultrahard layer 334 comprises a polycrystalline diamond layer. As explained above, when a polycrystalline diamond layer is used, the layer may further be partially or completely leached. A beveled, or chamfered, edge 336 may be provided on at least one side of the ultrahard layer 334, but more commonly, may be placed on at least two sides, so that the cutter may be removed and reoriented for use a second time. Further, at least one recessed region 338 is formed on an outer surface of the cutter behind the cutting face 349 of the ultrahard layer 334. In one embodiment, a start 356 of the recessed region 338 is disposed a selected distance behind the cutting face 349. In one embodiment, the recessed region 338 comprises a notch, or indentation, formed behind a chamfered edge 336 of the ultrahard layer 334. As shown in FIG. 10, in one embodiment, two recessed regions, or notches, 338, 340 are formed behind the chamfered edge 336 of the ultrahard layer 334. The recessed regions 338, 340 are notches formed behind the chamfered edge 336 and may extend across the interface 342 between the ultrahard layer 334 and the substrate 332. The recessed regions 338, 340 increase the surface area of the ultrahard layer 334, and thus increase the area that may be leached. Increased leaching area near the cutting face 349 may extend the life of the cutter. Multiple recessed regions may be placed around the circumference of the cutter 300 so that the cutter 300 may be removed and reoriented for multiple uses. While the recessed regions 338, 340 appear to be oval in shape, one of ordinary skill in the art will appreciate that other shapes and sizes of recessed regions may be used without departing from the scope of the invention.

Figure 9A:
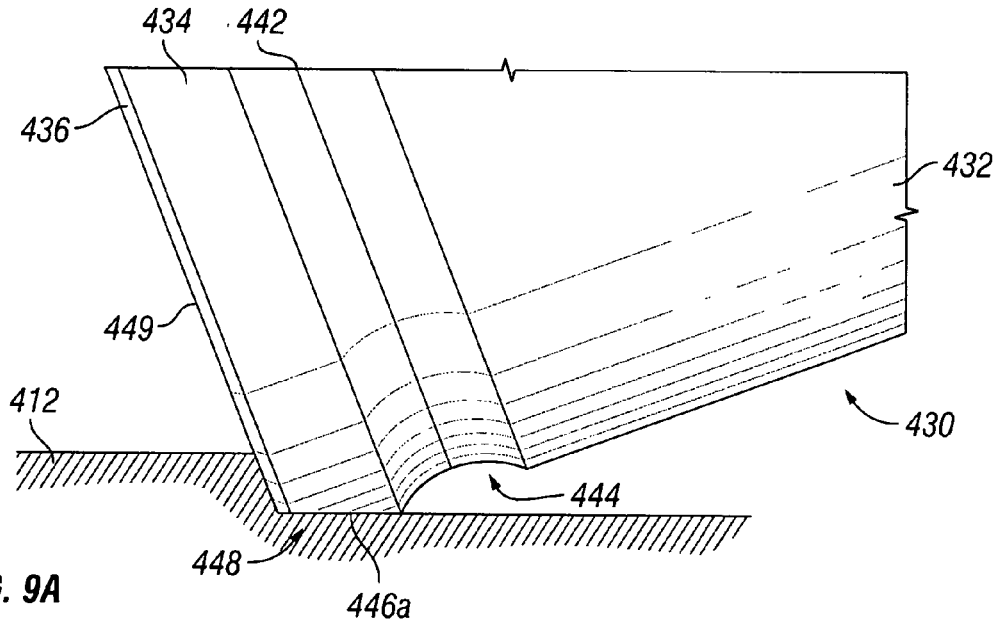
FIGS. 9*a* and 9*b* show a cutter in accordance with an embodiment of the present invention.
Figure 9B:
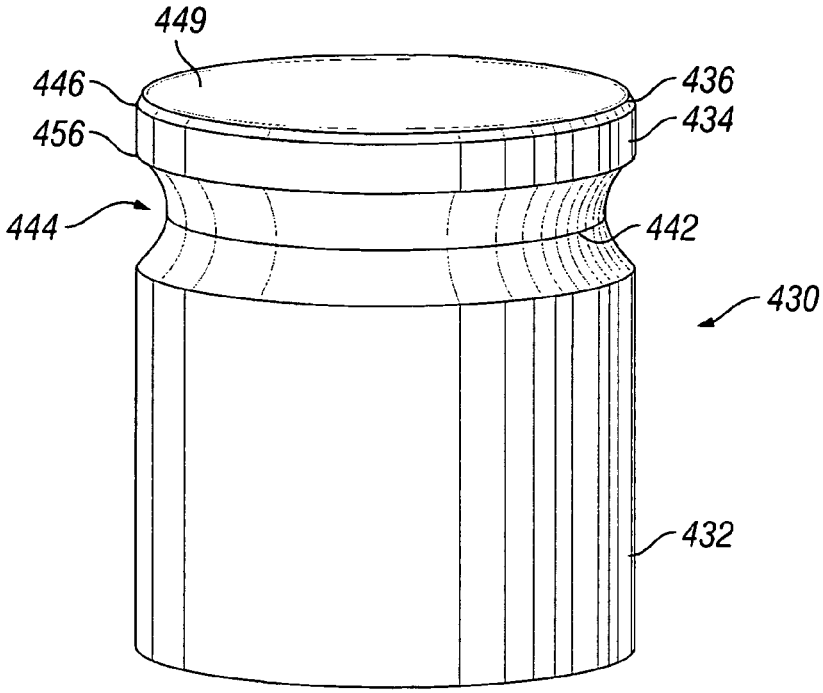

In another embodiment, shown in FIG. 9*b*, a recessed region 444 is achieved by creating a full cut around the circumference of a cutter 430. The recessed region 444 is formed behind the cutting face 449 of the cutter 430. In one embodiment, a start 456 of the recessed region 444 is disposed a selected distance behind the cutting face 449. In another embodiment, the recessed region 444 is formed behind a chamfered edge 436 of an ultrahard layer 434. The recessed region 444 may extend across the interface 442 of the ultrahard layer 434 and the substrate 432. A cutting edge 446 is formed to engage a formation.

A cutter in accordance with embodiments of the invention has a cutting face with an outer diameter substantially similar to the outer diameter of the base portion of the cutter. At least one recessed region formed behind the cutting face of the cutter provides a smaller cutter bearing surface when engaged with a formation. The smaller bearing surface requires less WOB as the cutter dulls during operation to maintain ROP. The decreased WOB may reduce the amount of friction heat on the cutter. Additionally, the at least one recessed region formed behind the cutting face of the cutter provides a larger area of the ultrahard layer that may be leached. Increased leaching area near the cutting face may extend the life of the cutter.

Figure 8:
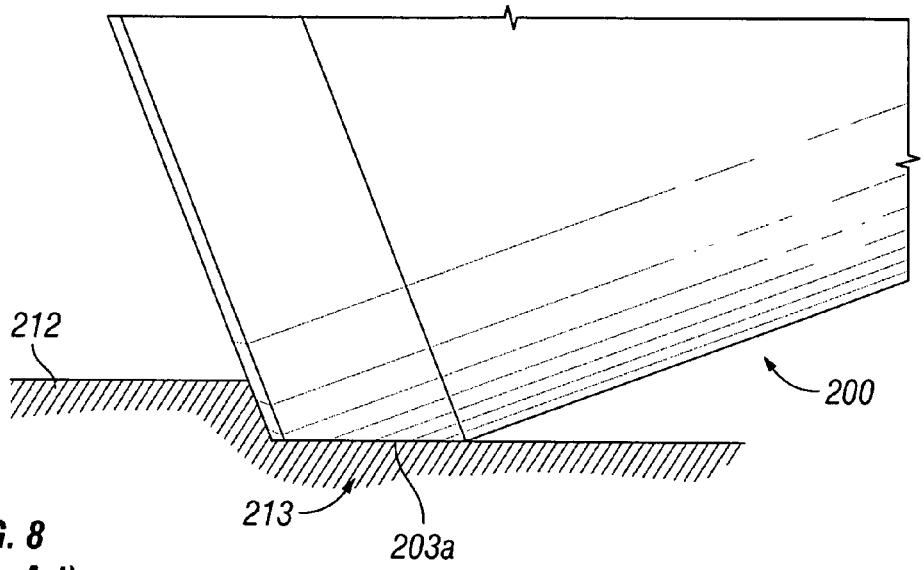
FIG. 8 (Prior Art)
FIG. 8 is a schematic partial view of a prior art partially worn cutter engaging a formation.

FIG. 9*a* shows the cutter 430, in accordance with an embodiment of the invention, engaged with a formation 412. The cutter 430 shows a cutter edge 446*a* dulled from engagement with the formation 412. A bearing surface 448 of the cutter 430 is the area of the cutter 430 that is in contact with the formation 412. The dulled cutting edge 446*a* has a smaller bearing surface 448 than conventional cutters that have become dulled. In one embodiment, the bearing surface 448 of the dulled cutting edge 446*a* may be 40% smaller than, for example, the bearing surface 213 of the dulled cutting edge 203*a* of conventional cutter 200 shown in FIG. 8.

As a result of a smaller bearing surface 448 of a cutter 430, less WOB is required to maintain a desired ROP. Additionally, cutter durability and cutting efficiency may both be improved. The smaller bearing surface 448 of the cutting edge 446, in accordance with an embodiment of the invention, provides the cutter 430 with a unique sharp edge that maintains the sharp cutter edge longer. Thus, the cutter is less likely to experience mechanical or thermal breakdown, or spall or crack.

Cutters formed in accordance with embodiments of the present invention may be used either alone or in conjunction with standard cutters depending on the desired application. In addition, while reference has been made to specific manufacturing techniques, those of ordinary skill will recognize that any number of techniques may be used.

Figure 11:
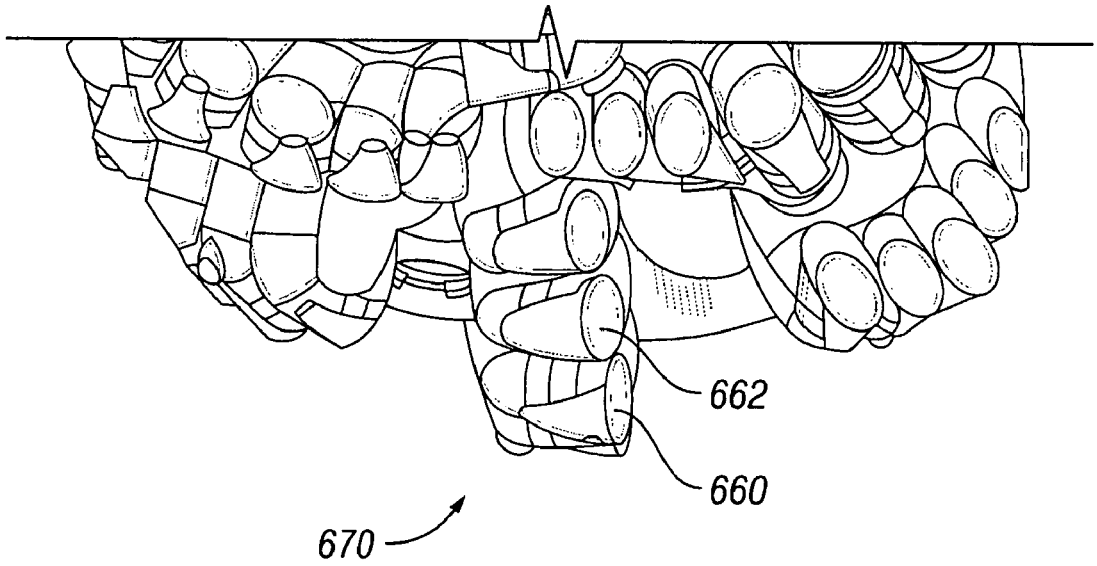
FIG. 11 shows a blade including cutters in accordance with an embodiment of the present invention.
Figure 12:
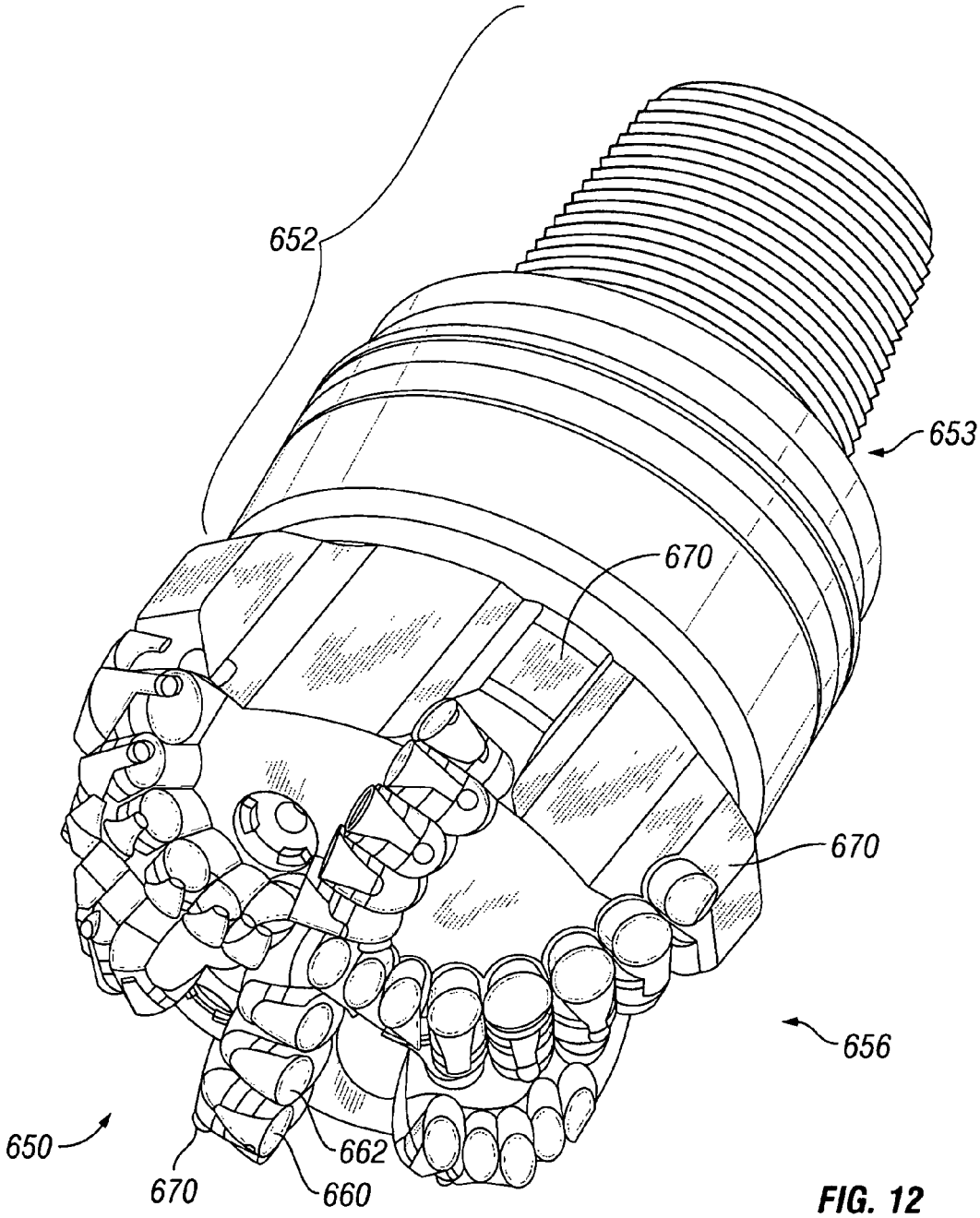
FIG. 12 shows a PDC bit including cutters formed in accordance with an embodiment of the present invention.

FIG. 11 shows a view of cutters formed in accordance with embodiments of the present invention disposed on a blade of a PDC bit. In FIG. 11, modified cutters 660 are intermixed on a blade 670 with standard cutters 662. Similarly, FIG. 12 shows a PDC bit having modified cutters 660 disposed thereon, and intermixed with standard cutters 662. Referring to FIG. 12, the fixed-cutter bits (also called drag bits) 650 comprise a bit body 652 having a threaded connection at one end 653 and a cutting head 656 formed at the other end. The head 656 of the fixed-cutter bit 650 comprises a plurality of blades 670 arranged about the rotational axis of the bit and extending radially outward from the bit body 652. Modified cutting elements 660 are embedded in the blades 670 to cut through earth formation as the bit is rotated on the earth formation. As discussed above, the modified cutting elements may be mixed with standard cutting elements 662.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutter comprising:

a base portion;

an ultrahard layer disposed on said base portion; and at least one concave recessed region disposed in the ultrahard layer of an outer surface of the cutter, wherein the at least one concave recessed region is disposed across an interface of the base portion and the ultrahard layer, wherein the at least one concave recessed region is disposed behind a cutting face so that the concave recessed region and the cutting face do not intersect, and wherein the ultrahard layer comprises a chamfered edge disposed on the cutting face.

2. The cutter of claim 1, wherein the ultrahard layer comprises thermally stable polycrystalline diamond.

3. The cutter of claim 1, wherein the at least one concave recessed region extends around the entire circumference of the cutter.

4. The cutter of claim 1 wherein the at least one concave recessed region comprises at least one notch.

5. The cutter of claim 1, wherein the at least one concave recessed region is an indentation.

6. A drill bit comprising:

a bit body; and at least one cutter, the at least one cutter comprising a base portion, an ultrahard layer disposed on said base portion, and at least one concave recessed region disposed in the ultrahard layer of an outer surface of the cutter, wherein the at least one concave recessed region is disposed across an interface of the base portion and the ultrahard layer, wherein the at least one concave recessed region is disposed behind a cutting face so that the concave recessed region and the cutting face do not intersect, and wherein the ultrahard layer comprises a chamfered edge disposed on the cutting.

7. The drill bit of claim 6, further comprising:

at least one other cutter, the at least one other cutter comprising a base portion and an ultrahard layer disposed on said base portion, wherein the at least one other cutter does not have a recessed region formed therein.

8. The drill bit of claim 6, wherein the at least one concave recessed region is an indentation.

9. A method of drilling, comprising:

contacting a formation with a drill bit, wherein the drill bit comprises a bit body; and at least one cutter, the at least one cutter comprising a base portion, an ultrahard layer disposed on said base portion, and at least one concave recessed region disposed in the ultrahard layer of an outer surface of the cutter, wherein the at least one concave recessed region is disposed across an interface of the base portion and the ultrahard layer, wherein the at least one concave recessed region is disposed behind a cutting face so that the concave recessed region and the cutting face do not intersect, and wherein the ultrahard layer comprises a chamfered edge disposed on the cutting.

* * * * *